US006977564B2

(12) United States Patent
Kanba et al.

(10) Patent No.: US 6,977,564 B2
(45) **Date of Patent: *Dec. 20, 2005**

(54) BANDPASS FILTER

(75) Inventors: Seiji Kanba, Kusatsu (JP); Naoki Mizoguchi, Moriyama (JP); Hisatake Okamura, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/784,335

(22) Filed: Feb. 23, 2004

(65) Prior Publication Data

US 2004/0174235 A1 Sep. 9, 2004

(30) Foreign Application Priority Data

Mar. 7, 2003 (JP) ..... 2003-061937
Nov. 28, 2003 (JP) ..... 2003-398895

(51) Int. Cl.[7] ..... H01P 1/203; H01P 7/08
(52) U.S. Cl. ..... 333/204; 333/219
(58) Field of Search ..... 333/185, 204, 333/219

(56) References Cited

U.S. PATENT DOCUMENTS 2,922,968 A 1/1960 Van Patten
4,270,106 A 5/1981 Woermbke
4,686,496 A 8/1987 Syrett
5,834,994 A * 11/1998 Shapiro ..... 333/204
5,977,850 A * 11/1999 Chaturvedi ..... 333/204
6,822,534 B2 * 11/2004 Uriu et al. ..... 333/204
2002/0053960 A1 * 5/2002 Kanba et al. ..... 333/204
2004/0183629 A1 * 9/2004 Mizoguchi et al. ..... 333/219

FOREIGN PATENT DOCUMENTS

EP 1 128 460 8/2001
JP 2001-237610 8/2001
JP 2002-026606 1/2002
JP 2002-171107 6/2002
JP 2002325002 A * 11/2002 ..... H01P 1/203
JP 2002335111 A * 11/2002 ..... H01P 11/00
JP 2002-368503 12/2002

* cited by examiner

*Primary Examiner*—Seungsook Ham
(74) *Attorney, Agent, or Firm*—Keating & Bennett, LLP

(57) ABSTRACT

A bandpass filter includes a dielectric substrate, a resonator electrode that is provided on a portion of a plane at an intermediate height in the thickness direction of the dielectric substrate so as to oppose the top face of the dielectric substrate and includes an aperture, first and second ground electrodes provided over and under the resonator electrode, respectively, so as to oppose the resonator electrode with dielectric layers disposed therebetween and so as to sandwich the resonator electrode, input-output coupling electrodes coupled to the resonator electrode, input-output terminal electrodes that are provided on the outside surface of the dielectric substrate and are electrically connected to the input-output coupling electrodes, and a via-hole electrode that penetrates through the aperture in the thickness direction of the dielectric substrate so as not to be electrically connected to the resonator electrode and is electrically connected to the first and second ground electrodes.

11 Claims, 17 Drawing Sheets

BANDPASS FILTER

BACKGROUND OF THE INVENTION

1. Field of the Invention

The present invention relates to bandpass filters used in, for example, communication equipment for a band from microwaves to millimeter waves and, more particularly, to a bandpass filter configured to suppress spurious signals that occur depending on the positional relationship between ground electrodes and a resonator electrode.

2. Description of the Related Art

Various dual-mode bandpass filters have been used as bandpass filters for use in high-frequency bands.

For example, a dual-mode bandpass filter including a resonator electrode having an aperture is disclosed in Japanese Unexamined Patent Application Publication No. 2001-237610. FIG. 17A is a cross-sectional front view and FIG. 17B is a plan view, schematically showing a dual-mode bandpass filter 101 disclosed in this publication. The dual-mode bandpass filter 101 includes a dielectric substrate 102. A resonator electrode 103 is provided at an intermediate height in the dielectric substrate 102. The resonator electrode 103 includes an aperture 103*a* (an area where no electrode is formed in the resonator electrode 103). The resonator electrode 103 includes a plurality of non-degenerate resonant modes. The aperture 103*a* is arranged to couple the resonant modes to each other to define the dual-mode bandpass filter. Ground electrodes 104 and 105 are provided beneath the top surface and on the bottom surface of the dielectric substrate 102, respectively, so as to oppose the resonator electrode 103. Referring to FIG. 17B, input-output coupling electrodes 106 and 107 are connected to the resonator electrode 103. The input-output coupling electrodes 106 and 107 extend outside the resonator electrode 103, although not shown in FIG. 17A, and are electrically connected to the corresponding input-output terminal electrodes (not shown).

Usually, in a bandpass filter, such as the dual-mode bandpass filter 101, including the ground electrodes provided over and under the resonator electrode with dielectric layers of the dielectric substrate disposed therebetween, ground electrodes are also provided on side surfaces of the dielectric substrate 102. Accordingly, the ground electrodes define a waveguide, that is, the resonator electrode 103 is provided in a waveguide. With such a structure, resonances occur depending only on the shape of the waveguide. Consequently, the structure, similar to a waveguide, including the ground electrodes is larger than the resonator electrode 103.

The fundamental resonances caused by the ground electrodes occur at frequencies lower than the resonant frequency of the resonator electrode 103, and higher-mode resonances sequentially occur at overlapping positions with resonant modes caused by the resonator electrode 103. Such resonances caused by the ground electrodes produce undesired spurious signals in the dual-mode bandpass filter 101, such that it is impossible to achieve good transmission characteristics.

SUMMARY OF THE INVENTION

To overcome the problems described above, preferred embodiments of the present invention provide a bandpass filter that prevents undesired spurious signals caused by the resonances of the ground electrodes to achieve good transmission characteristics.

According to a preferred embodiment of the present invention, a bandpass filter includes a dielectric substrate, a resonator electrode, first and second ground electrodes, input-output coupling electrodes, input-output terminal electrodes, and a via-hole electrode. The resonator electrode is provided on a portion of a plane at an intermediate height in the thickness direction of the dielectric substrate so as to be opposed to the top surface of the dielectric substrate and includes an aperture. The first and second ground electrodes are arranged over and under the resonator electrode, respectively, in the thickness direction of the dielectric substrate so as to oppose the resonator electrode with dielectric layers disposed therebetween and so as to sandwich the resonator electrode. The input-output coupling electrodes are coupled to the resonator electrode. The input-output terminal electrodes are provided on the outside surface of the dielectric substrate and are electrically connected to the input-output coupling electrodes. The via-hole electrode penetrates through the aperture in the thickness direction of the dielectric substrate so as not to be electrically connected to the resonator electrode and is electrically connected to the first and second ground electrodes.

The bandpass filter preferably includes second via-hole electrodes that are arranged in an area outside of the resonator electrode in plan view of the resonator electrode and that are electrically connected to the first and second ground electrodes.

It is preferable that the resonator electrode be configured so as to have a plurality of non-degenerate resonant modes, and such that the plurality of resonant modes are coupled to each other by the aperture to define the dual-mode bandpass filter.

The resonator electrode is preferably a ring resonator electrode. In such a case, controlling the coupling points to the input-output coupling electrodes provides the dual-mode bandpass filter.

The bandpass filter according to a preferred embodiment of the present invention is configured such that at least first and second ground electrodes are arranged over and under the resonator electrode so as to sandwich the resonator electrode. The bandpass filter includes the via-hole electrode that penetrates through the aperture in the resonator electrode and is electrically connected to the first and second ground electrodes. The via-hole electrode shifts the frequency of undesired spurious signals caused by the resonances of the ground electrodes to achieve good transmission characteristics that are not affected by the spurious signals.

The second via-hole electrodes in an area outside the resonator electrode cause the undesired spurious signals produced by the resonances of the ground electrodes to be spaced further away from the passband of the bandpass filter to achieve better transmission characteristics. The formation of the second via-hole electrodes prevents the variation in the frequency of the spurious signals even when a variation in the chip size is caused by the manufacturing errors of the bandpass filter. Hence, the bandpass filter has less variation in characteristics caused by the manufacturing errors.

When the resonator electrode is configured so as to have the a plurality of non-degenerate resonant modes and such that the resonant modes are coupled to each other by the aperture to define the dual-mode bandpass filter, the bandpass filter does not have any restrictions on the coupling points to the resonator electrode and provides various band characteristics by selecting the shapes of the resonator electrode and the aperture.

Other features, elements, characteristics, steps and advantages of the present invention will become more apparent from the following detailed description of preferred embodiments with reference to the attached drawings.

DETAILED DESCRIPTION OF PREFERRED EMBODIMENTS

Preferred embodiments of the present invention will now be described with reference to the drawings.

Figure 1A:
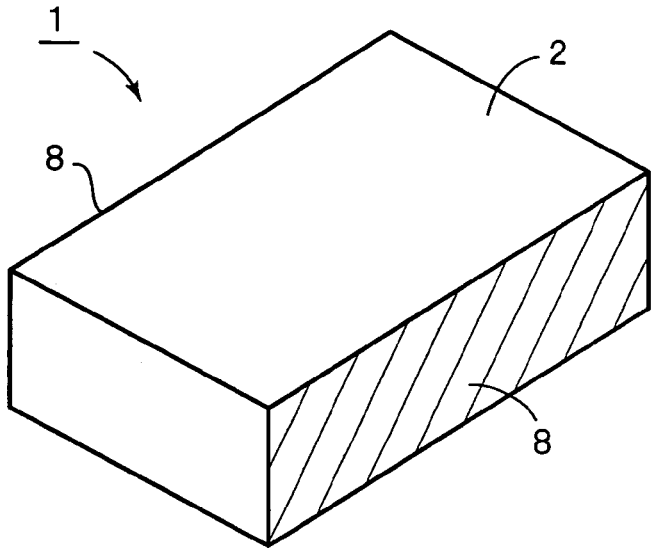
FIG. 1A is a perspective view of a dual-mode bandpass filter according to a first preferred embodiment of the present invention.
Figure 1B:
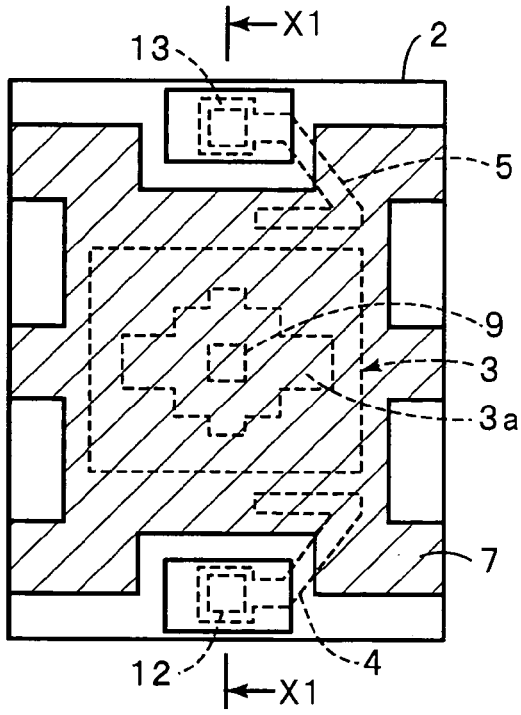
FIG. 1B is a bottom view of the dual-mode bandpass filter of the first preferred embodiment of the present invention.
Figure 1C:
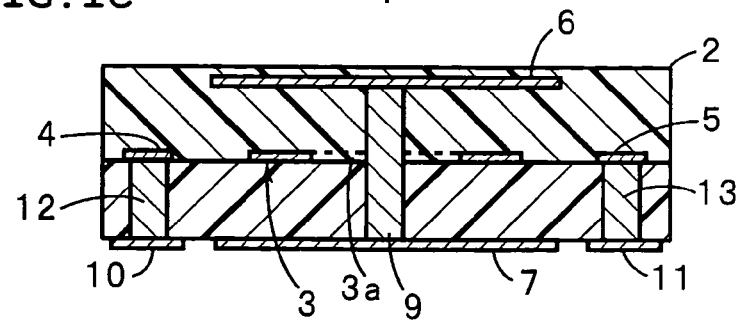
FIG. 1C is a cross-sectional side view of the dual-mode bandpass filter of the first preferred embodiment taken along line X1—X1 in FIG. 1B.

FIG. 1A is a perspective view of a dual-mode bandpass filter 1 according to a first preferred embodiment of the present invention. FIG. 1B is a bottom view of the dual-mode bandpass filter. FIG. 1C is a cross-sectional side view of the dual-mode bandpass filter taken along line X1—X1 in FIG. 1B.

The dual-mode bandpass filter 1 preferably includes a substantially rectangular dielectric substrate 2. The dielectric substrate 2 is preferably made of a suitable dielectric material. Such dielectric material includes a synthetic resin such as fluoroplastic and dielectric ceramics.

Figure 2:
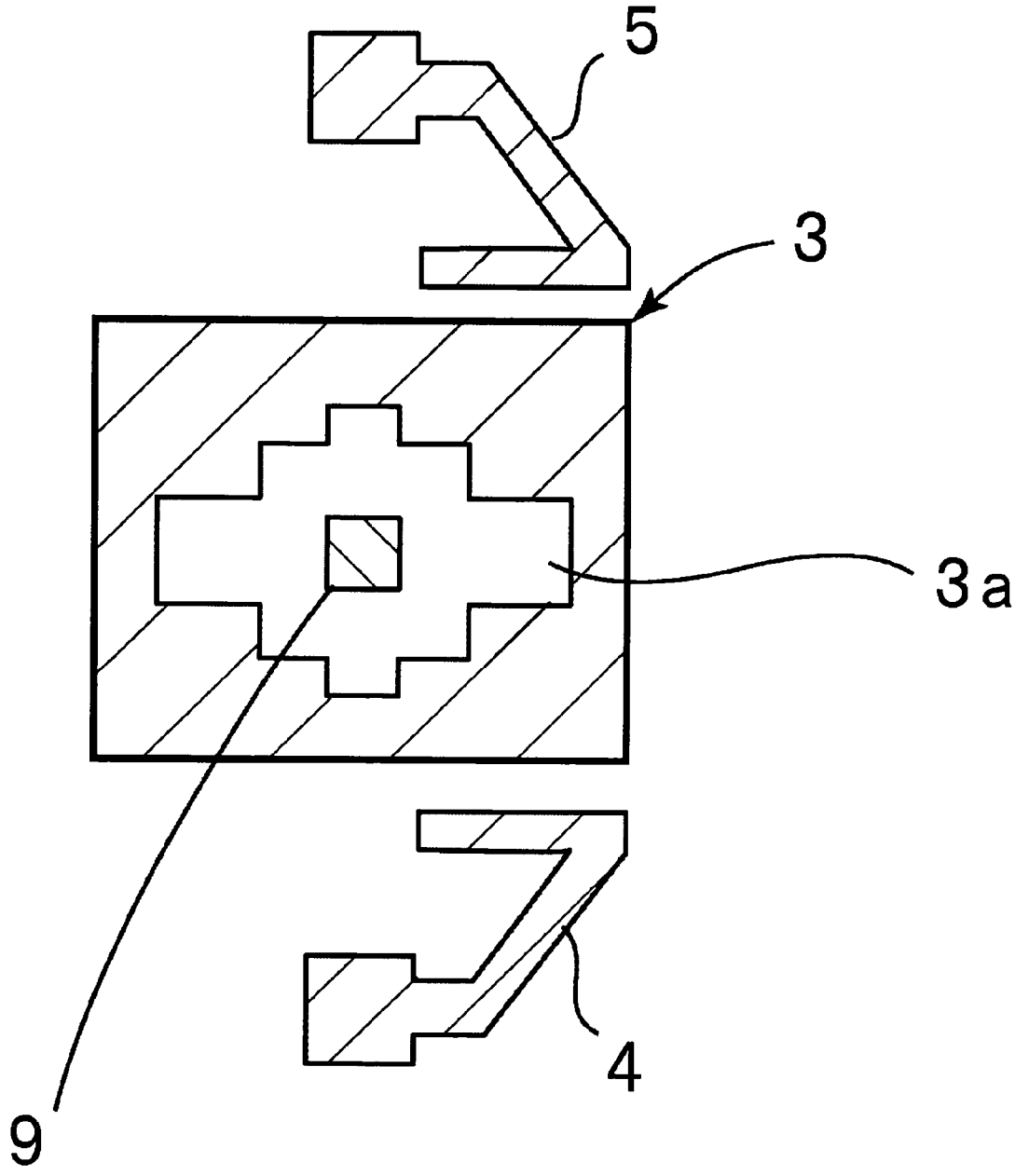
FIG. 2 is a plan view schematically showing a resonator electrode and input-output coupling electrodes of the dual-mode bandpass filter of the first preferred embodiment of the present invention.

The dielectric substrate 2 includes a resonator electrode 3 and input-output coupling electrodes 4 and 5 disposed at an intermediate height. According to the first preferred embodiment, the dielectric substrate 2 includes a plurality of dielectric layers. The resonator electrode 3 is disposed on a dielectric layer other than the top layer. FIG. 2 is a plan view schematically showing the planar shape of the resonator electrode 3 and the input-output coupling electrodes 4 and 5. The resonator electrode 3, which preferably has a substantially rectangular shape, includes an aperture 3*a* at its central portion thereof. The resonator electrode 3 includes a metal film whose composition is not particularly limited, such as a metal film made of aluminum, copper, or other suitable material or an alloy film. The input-output coupling electrodes 4 and 5 are also made of a similar metallic material.

The resonator electrode 3 being such a metal film is provided on a portion of a plane at an intermediate height in the dielectric substrate 2.

The input-output coupling electrodes 4 and 5 may be arranged at any appropriate positions as long as they are capable of being coupled to the resonator electrode 3. That is, the input-output coupling electrodes 4 and 5 may be disposed at a height that is different from the height at which the resonator electrode 3 is disposed.

The resonator electrode 3 has a shape so as to generate a plurality of non-degenerate resonant modes. Since the resonator electrode 3 includes the aperture 3*a,* the plurality of resonant modes are coupled to each other to provide the bandpass filter characteristics, as disclosed in the publication described above.

In the dual-mode bandpass filter 1, a first ground electrode 6 is provided on an upper level of the dielectric substrate 2 so as to oppose the resonator electrode 3 with dielectric layers therebetween. Although the first ground electrode 6 is disposed inside the dielectric substrate 2, the first ground electrode may be disposed on the top surface of the dielectric substrate 2.

A second ground electrode 7 is disposed beneath the bottom surface of the dielectric substrate 2 so as to oppose the resonator electrode 3 with dielectric layers therebetween. It is not necessary to dispose the second ground electrode 7 beneath the dielectric substrate 2. The second ground electrode 7 may be embedded at a height above the bottom surface of the dielectric substrate 2.

The first ground electrode 6 and the second ground electrode 7 are preferably larger than the resonator electrode 3, and the resonator electrode 3 is sandwiched between the first ground electrode 6 and the second ground electrode 7.

As shown in FIG. 1A, third ground electrodes 8 are provided on opposing sides of the dielectric substrate 2. The third ground electrodes 8 are electrically connected to the first ground electrode 6 and the second ground electrode 7.

As shown in FIG. 1C, a first via-hole electrode 9 is provided so as to penetrate through the aperture 3*a* in the resonator electrode 3. The first via-hole electrode 9 is electrically connected to the first ground electrode 6 and the second ground electrode 7.

The input-output coupling electrode 4 is electrically connected to an input-output terminal electrode 10 through a third via-hole electrode 12, and the input-output coupling electrode 5 is electrically connected to an input-output terminal electrode 11 through a third via-hole electrode 13. The input-output terminal electrodes 10 and 11 are provided beneath the bottom face of the dielectric substrate 2.

The operation and effect of the dual-mode bandpass filter 1 according to the first preferred embodiment will now be described.

When input signals are supplied from one of the input-output terminal electrodes 10 and 11 to the dual-mode bandpass filter 1 according to the first preferred embodiment, which includes the resonator electrode 3 and the aperture 3*a* that are provided as described above, a plurality of non-degenerate resonant modes occur in the resonator electrode 3. The resonant modes are coupled to each other by the aperture 3*a,* such that the other electrode of the input-output terminal electrodes 10 and 11 yields bandpass filter characteristics.

As described above, the resonator electrode 3 is surrounded by the first ground electrode 6, the second ground electrode 7, and the third ground electrodes 8 in a known dual-mode bandpass filter of this type. More specifically, the first ground electrode 6, the second ground electrode 7, and the third ground electrodes 8 define a waveguide, and, therefore, the resonance in the waveguide is apt to be spurious.

In contrast, with the dual-mode bandpass filter 1 according to the first preferred embodiment, the formation of the first via-hole electrode 9 suppresses undesirable spurious signals caused by the resonances of the first ground electrode 6, the second ground electrode 7, and the third ground electrodes 8. This will be described below with reference to FIGS. 3 to 7 based on specific experiments.

In the experiments below, the size of the dielectric substrate 2 used, which is made of ceramic including magnesium and silicon as primary ingredients, is about 2.5 mm wide by about 3.2 mm long by about 1.0 mm thick. The resonator electrode 3 has a size of about 1.4 mm wide by about 1.5 mm long, and the aperture 3*a* has an area of about 0.54 $mm^2$.

Figure 3:
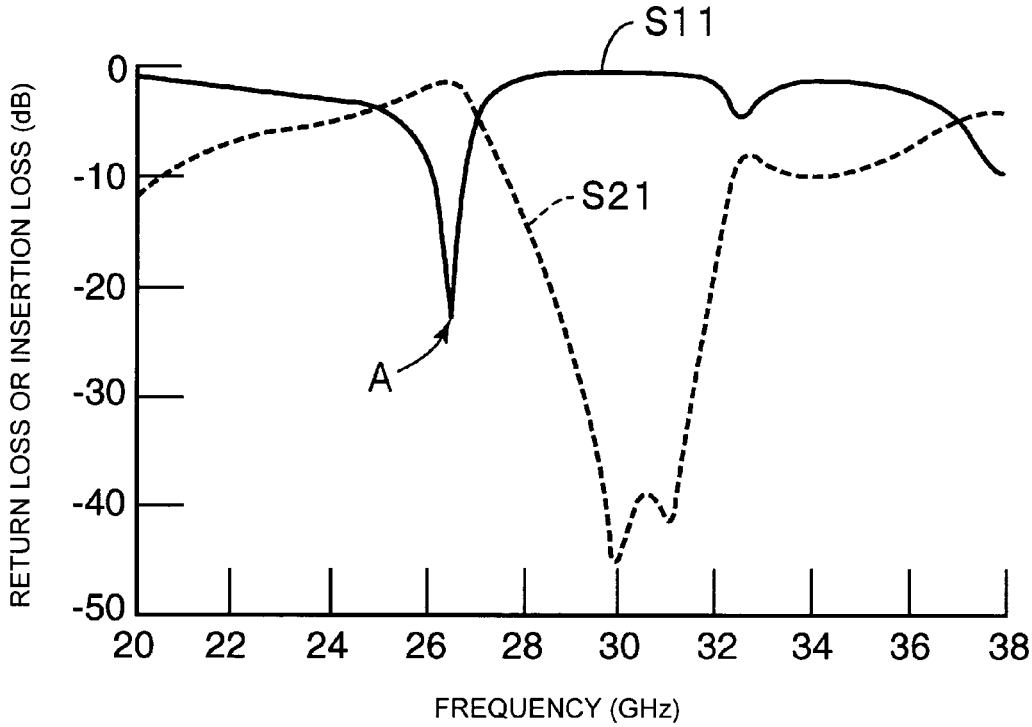
FIG. 3 shows S-parameter frequency characteristics in a structure where a first via-hole electrode and the resonator electrode are removed from the dual-mode bandpass filter of the first preferred embodiment of the present invention.

FIG. 3 shows S-parameter frequency characteristics in a configuration in which the resonator electrode 3 and the first via-hole electrode 9 are removed from the dual-mode bandpass filter 1 according to the first preferred embodiment. FIG. 3 shows that resonance indicated by an arrow A occurs at a frequency of about 26.46 GHz for a characteristic S11. This resonance corresponds to the resonance resulting from the configuration having the first ground electrode 6, the second ground electrode 7, and the third ground electrodes 8. More specifically, the fundamental resonance caused by the first to third ground electrodes 6 to 8 occurs at about 26.46 GHz.

Figure 4:
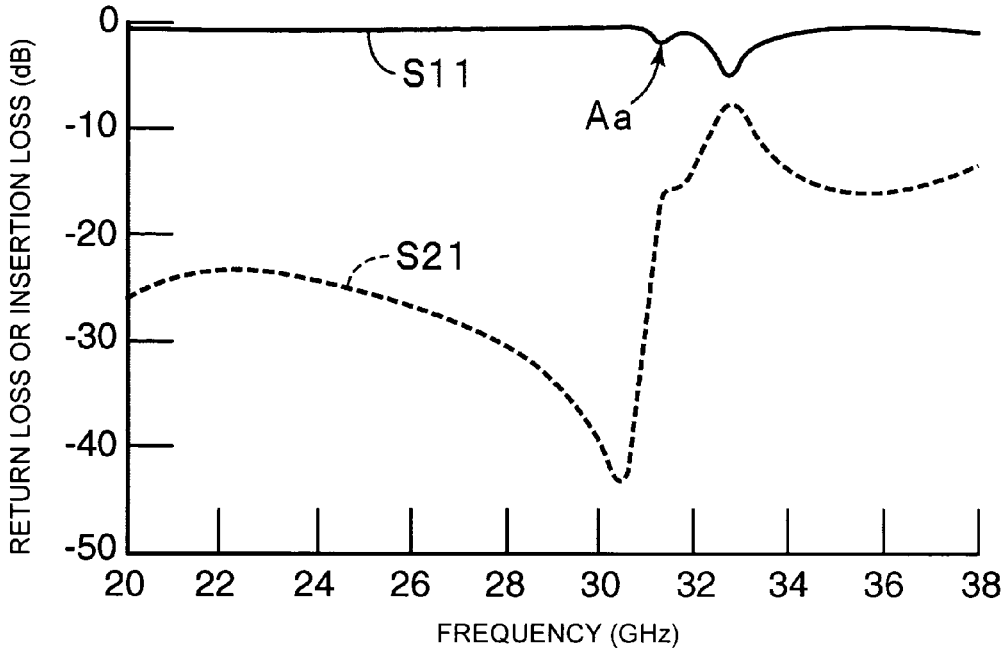
FIG. 4 shows S-parameter frequency characteristics in a structure where the resonator electrode are removed from the dual-mode bandpass filter of the first preferred embodiment of the present invention.

FIG. 4 shows S-parameter frequency characteristics when only the resonator electrode 3 is removed from the dual-mode bandpass filter 1 according to the first preferred embodiment. That is, the structure in FIG. 4 is the same as the structure having the transmission characteristics shown in FIG. 3 except for the provision of the first via-hole electrode 9.

As shown by arrow Aa in FIG. 4, the provision of the first via-hole electrode 9 causes the fundamental resonance caused by the first to third ground electrodes 6 to 8 to occur at a frequency of about 31.32 GHz.

The comparison between FIG. 3 and FIG. 4 shows that the provision of the first via-hole electrode 9 increases the frequency of the fundamental resonance caused by the first to third ground electrodes 6 to 8 by about 5 GHz.

Thus, the first via-hole electrode 9 shifts the frequency of the fundamental resonance and the frequency of a higher-mode resonance caused by the first to third ground electrodes 6 to 8 toward higher frequencies.

Figure 5:
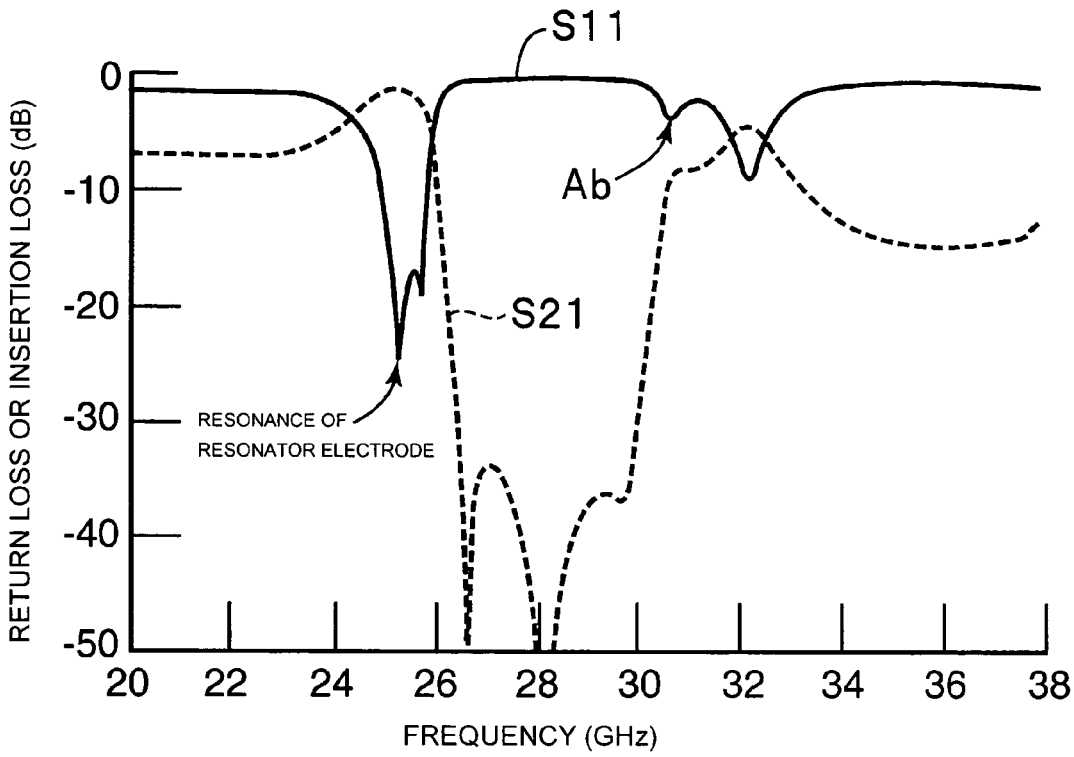
FIG. 5 shows S-parameter frequency characteristics of the dual-mode bandpass filter of the first preferred embodiment of the present invention.

FIG. 5 shows S-parameter frequency characteristics of the structure shown in FIGS. 1A to 1C. Referring to FIG. 5, the resonant modes around a frequency of about 25.5 GHz represent the resonant modes produced by the resonator electrode 3. The resonant modes are coupled to each other by the formation of the aperture 3*a,* thus achieving the bandpass filter characteristic. In contrast, the resonance caused by the first to third ground electrodes 6 to 8 occurs at a frequency of about 30.73 GHz, as shown by an arrow Ab. Accordingly, as shown in FIG. 5, the resonant frequency of the resonator electrode 3 for providing the bandpass filter characteristics is different from the resonant frequency of the first to third ground electrodes 6 to 8.

Figure 6:
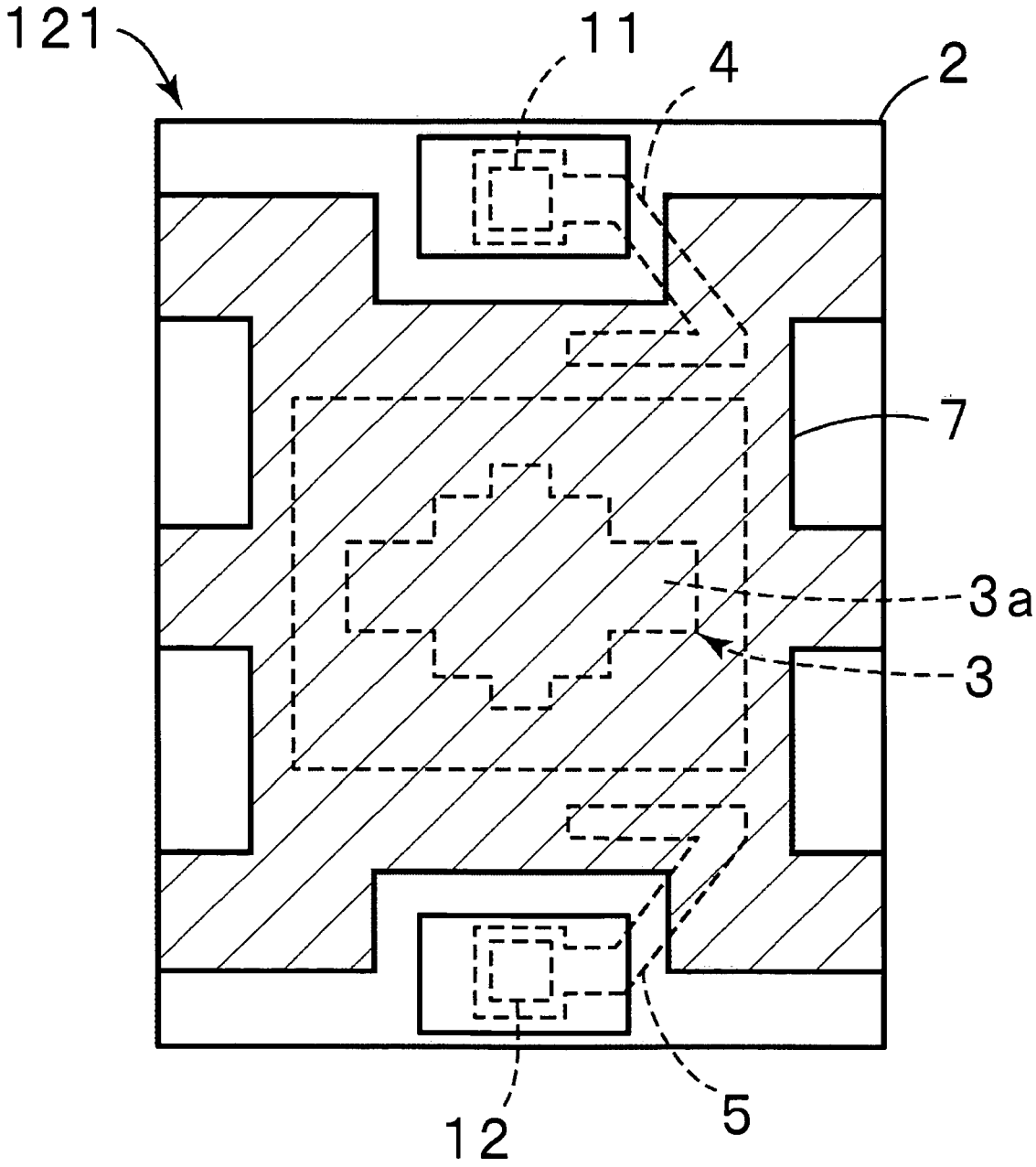
FIG. 6 PRIOR ART
FIG. 6 is a plan view schematically showing a known dual-mode bandpass filter for comparison.

For comparison, the transmission characteristics of a known dual-mode bandpass filter 121 shown in FIG. 6 were measured. The dual-mode bandpass filter 121 has the same structure as the dual-mode bandpass filter 1 in FIGS. 1A to 1C except for the removal of the first via-hole electrode 9.

Figure 7:
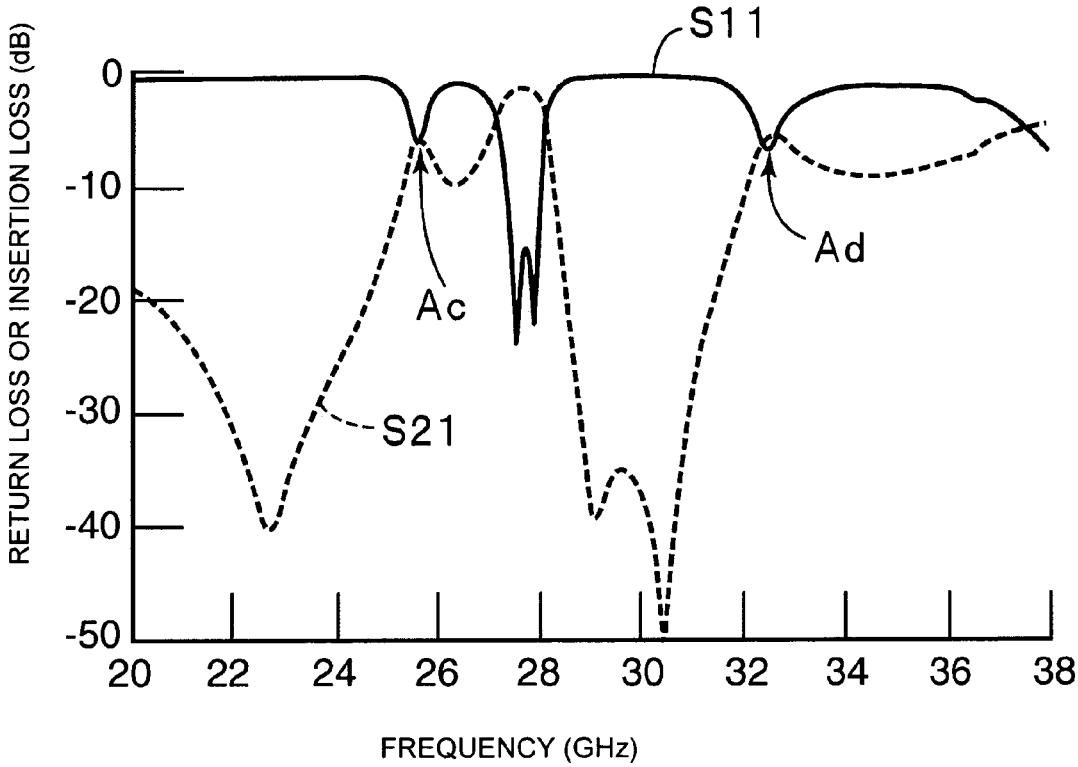
FIG. 7 PRIOR ART
FIG. 7 shows S-parameter frequency characteristics of the known dual-mode bandpass filter shown in FIG. 6.

FIG. 7 shows S-parameter frequency characteristics of the dual-mode bandpass filter 121. Referring to FIG. 7, the resonances caused by the resonator electrode 3 occur around a frequency of about 27.7 GHz in the known dual-mode bandpass filter 121. The resonances caused by the ground electrodes occur at about 25.58 GHz and about 32.49 GHz, as shown by arrows Ac and Ad. That is, the fundamental resonances and the higher-mode resonances caused by the ground electrodes occur on both sides of the passband of the dual-mode bandpass filter 121.

The comparison between FIG. 5 and FIG. 7 shows that, in the dual-mode bandpass filter 1 according to the first preferred embodiment, the first via-hole electrode 9 eliminates the effect of undesirable spurious signals caused by the resonances of the first to third ground electrodes 6 to 8, thus achieving good transmission characteristics.

The first via-hole electrode 9 is configured such that the resonance caused by the first to third ground electrodes 6 to 8 arranged so as to surround the resonator electrode occurs outside the passband of the dual-mode bandpass filter, as described above. This formation eliminates the effect of undesirable spurious signals caused by the resonances of the first to third ground electrodes 6 to 8, thus achieving good transmission characteristics, as in the first preferred embodiment.

Since the first to third ground electrodes 6 to 8 are provided so as to surround the resonator electrode 3 in the dual-mode bandpass filter 1 according to the first preferred embodiment, the radiation from the resonator electrode 3 is suppressed so as suppress an increase in the insertion loss of the filter caused by radiation loss and to prevent the dual-mode bandpass filter from acting as a noise source. A shift in filter characteristics, which occurs when other electronic parts, a casing, or other components are disposed close to the dual-mode bandpass filter 1 is also suppressed.

The reason that the spurious signals caused by the resonances of the first to third ground electrodes 6 to 8 are shifted by providing the first via-hole electrode 9 will be described below.

Figure 8A:
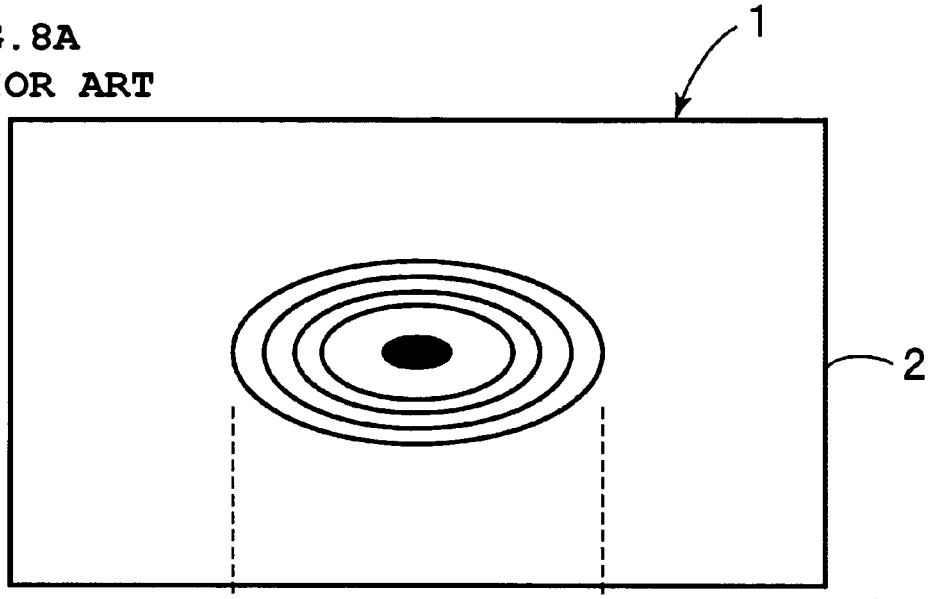
FIG.8A PRIOR ART
FIG. 8A is a plan view and FIG. 8B is a cross-sectional front view schematically showing the electric field distribution of a known dual-mode bandpass filter having no via-hole electrode.
Figure 8B:
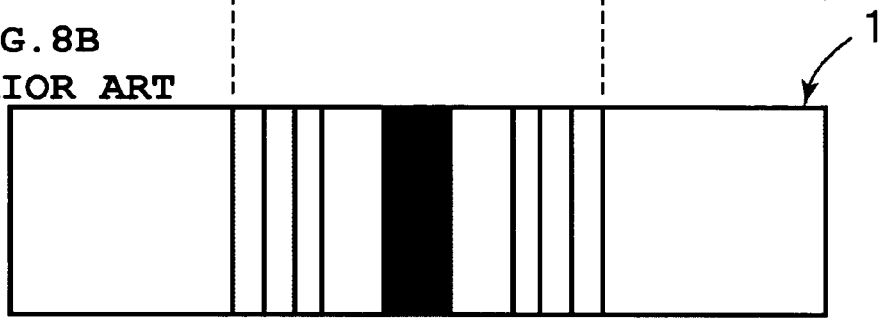
FIG.8B PRIOR ART

FIG. 8A is a plan view and FIG. 8B is a cross-sectional front view schematically showing the electric field distribution at the fundamental resonant frequency of the first to third ground electrodes 6 to 8, that is, the electric field distribution at about 26.46 GHz, in the known dual-mode bandpass filter. In this electric field distribution, the electric field strengthens as the density of black stripes increases. As shown in FIGS. 8A and 8B, a strong electric field occurs at the central portion on the main surface of the dielectric substrate.

Figure 9A:
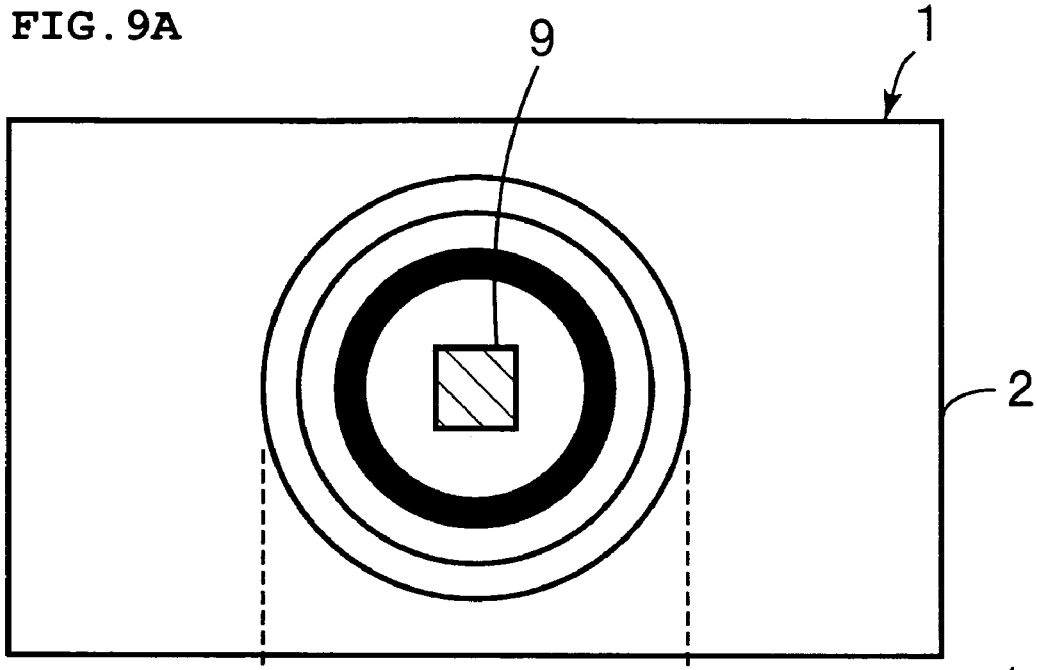
FIG. 9A is a plan view and FIG. 9B is a cross-sectional front view schematically showing the electric field distribution of the dual-mode bandpass filter of the first preferred embodiment of the present invention.
Figure 9B:
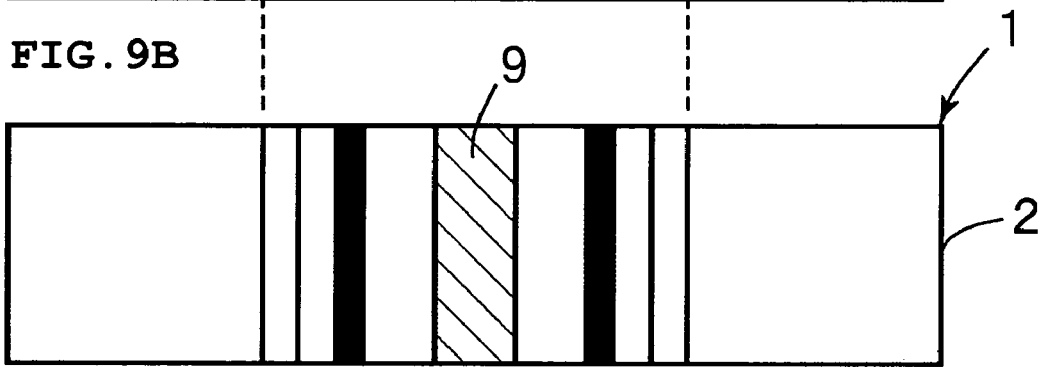

In contrast, FIG. 9A is a plan view and FIG. 9B is a cross-sectional front view schematically showing the electric field distribution at the fundamental resonant frequency of the first to third ground electrodes 6 to 8, that is, the electric field distribution at about 31.32 GHz, in the dual-mode bandpass filter 1 according to the first preferred embodiment having the first via-hole electrode 9. As shown in FIGS. 9A and 9B, the first via-hole electrode 9 at the central portion of the main surface of the dielectric substrate 2 eliminates the strong electric field in FIG. 8.

In other words, since the first via-hole electrode 9 is short-circuited to the first ground electrode 6 and the second ground electrode 7, the electric field does not occur in and around an area where the first via-hole electrode 9 is provided. Hence, according to the first preferred embodiment, the first via-hole electrode 9 prevents the occurrence of a strong resonance at the central portion of the dielectric substrate 2, or prevents the periphery of the first via-hole electrode 9 from contributing to the resonance caused by the first to third ground electrodes 6 to 8. As a result, the structure defining the waveguide is reduced in size so as to increase the frequency of the fundamental resonance caused by the first to third ground electrodes 6 to 8.

Figure 10A:
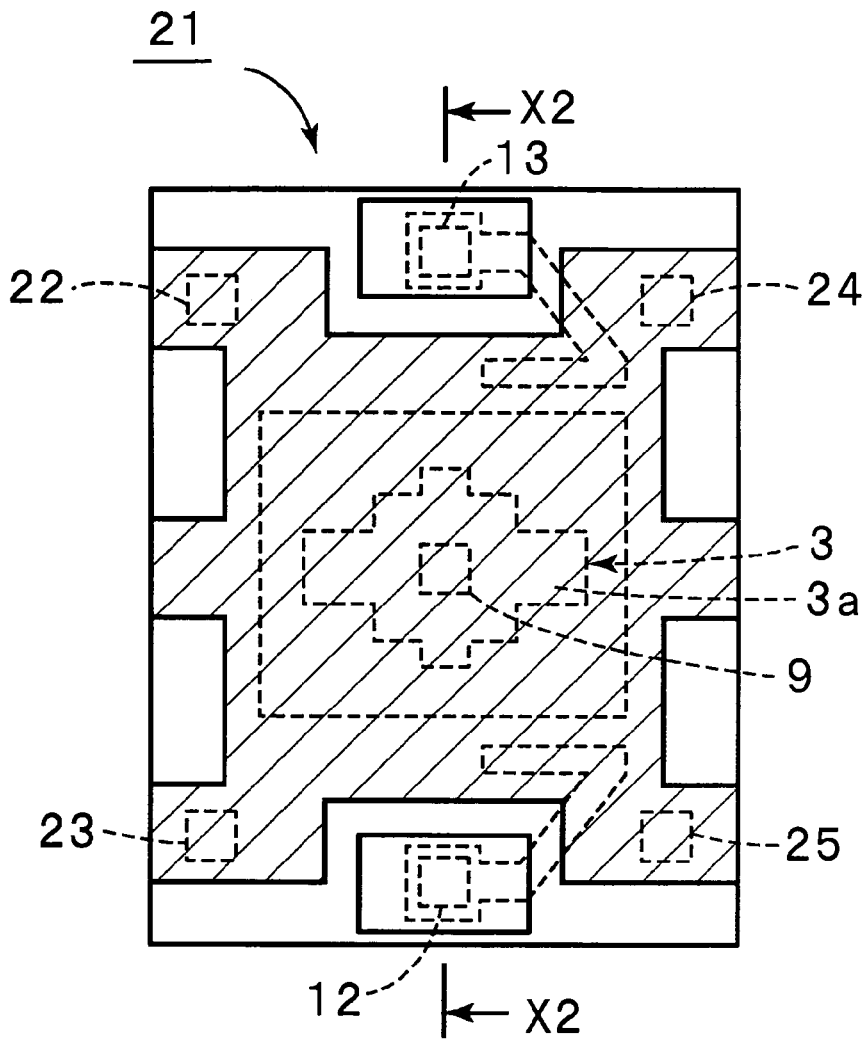
FIG. 10A is a bottom view of a dual-mode bandpass filter according to a second preferred embodiment of the present invention.
Figure 10B:
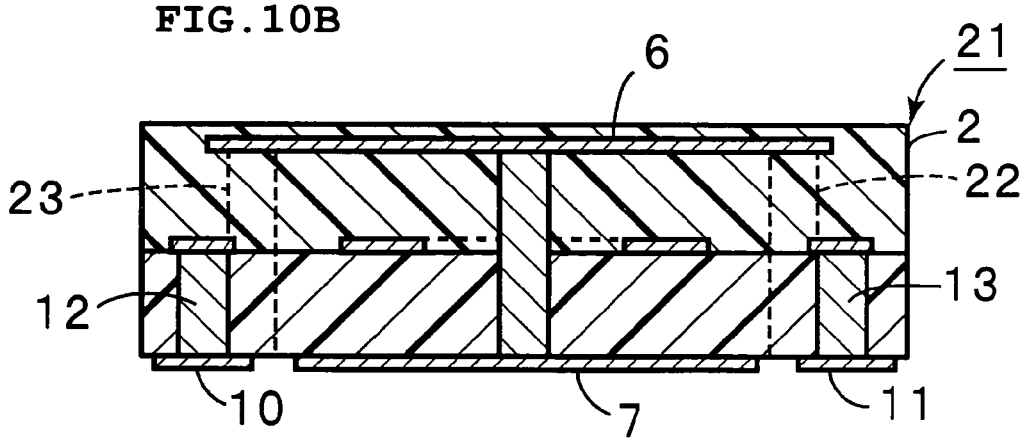
FIG. 10B is a cross-sectional side view of the dual-mode bandpass filter of the second preferred embodiment taken along line X2—X2 in FIG. 10A.

FIG. 10A is a bottom view of a dual-mode bandpass filter 21 according to a second preferred embodiment of the present invention. FIG. 10B is a cross-sectional side view of the dual-mode bandpass filter 21 taken along line X2—X2 in FIG. 10A.

The dual-mode bandpass filter 21 of the second preferred embodiment is configured in the same manner as the dual-mode bandpass filter 1 of the first preferred embodiment except that second via-hole electrodes 22 to 25 are provided. In the plan view of the dual-mode bandpass filter 21, a plurality of second via-hole electrodes 22 to 25 are provided outside an area where the resonator electrode 3 is provided. The second via-hole electrodes 22 to 25 are electrically connected to the first ground electrode 6 and the second ground electrode 7, like the first via-hole electrode 9.

In the dual-mode bandpass filter 21, the second via-hole electrodes 22 to 25 shifts undesired spurious signals caused by the resonances of the first to third ground electrodes 6 to 8 toward higher frequencies to reduce the effect of the spurious signals. This will be described below with reference to FIGS. 11 to 13.

Figure 11:
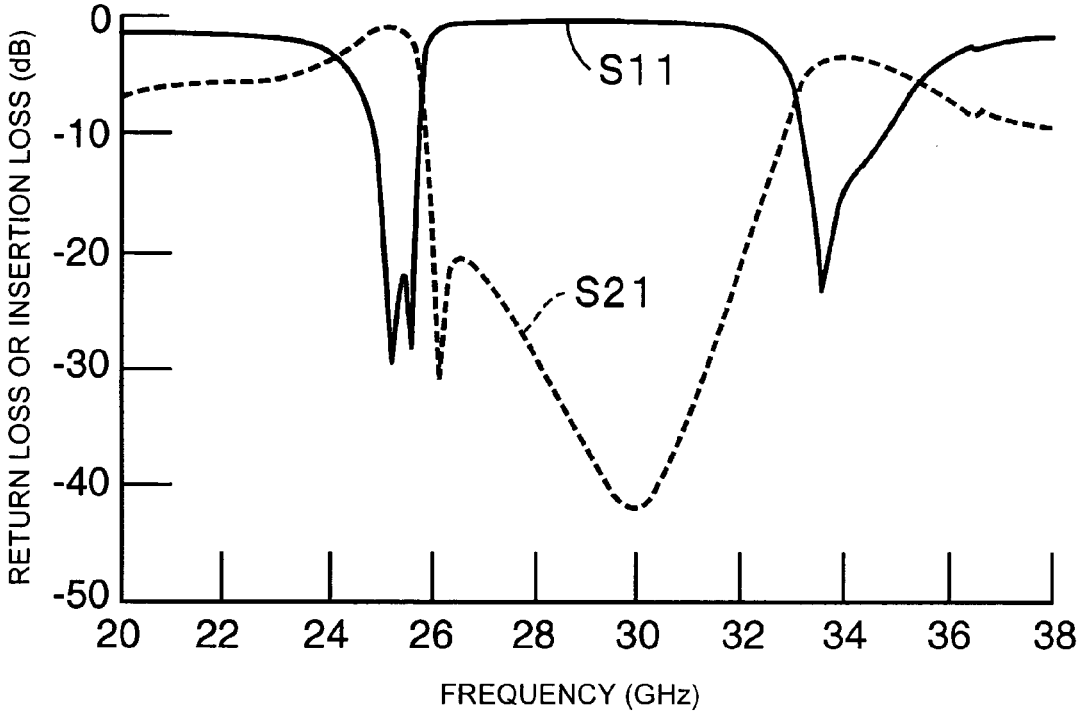
FIG. 11 shows S-parameter frequency characteristics of the dual-mode bandpass filter of the second preferred embodiment of the present invention.
Figure 12:
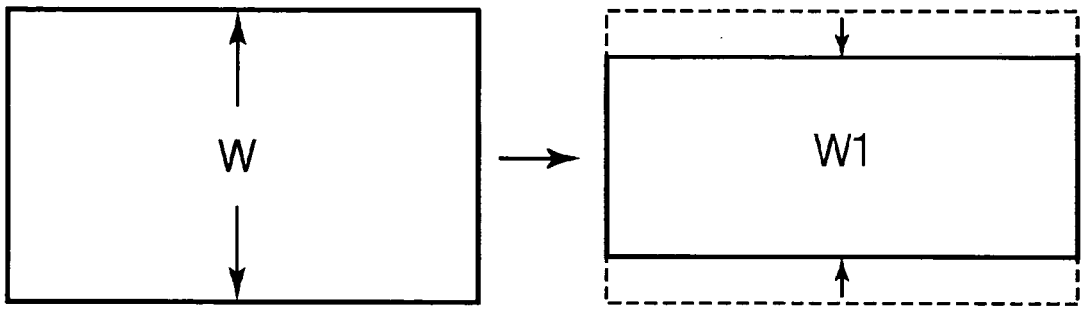
FIG. 12 includes schematic plan views illustrating a case in which the width of the dual-mode bandpass filter is decreased.

FIG. 11 shows S-parameter frequency characteristics of the dual-mode bandpass filter 21. The fundamental resonance caused by the first to third ground electrodes 6 to 8 occurs at about 30.73 GHz in FIG. 5, showing the transmission characteristics of the dual-mode bandpass filter 1 according to the first preferred embodiment, while the fundamental resonance caused by the first to third ground electrodes 6 to 8 occurs at a higher frequency of about 33.56 GHz in FIG. 11. Referring to FIG. 11, the resonances caused by the resonator electrode 3 occur around 25.5 GHz.

In the dual-mode bandpass filter 21 according to the second preferred embodiment, the addition of the second via-hole electrodes 22 to 25 shifts undesired spurious signals caused by the resonances of the first to third ground electrodes 6 to 8 toward higher frequencies to further reduce the effect of the spurious signals. This is because the second via-hole electrodes 22 to 25 produce an area that does not contribute to the resonance around the second via-hole electrodes 22 to 25, thus reducing the size of the structure defining the waveguide as compared with the dual-mode bandpass filter 1 of the first preferred embodiment, and increasing the resonant frequency of the first to third ground electrodes 6 to 8.

With the dual-mode bandpass filter 21, the frequency variations due to manufacturing errors are reduced. It is assumed that the width W of the dual-mode bandpass filter is decreased to W1 due to the manufacturing errors, as shown in the diagram at the right in FIG. 12.

Figure 13:
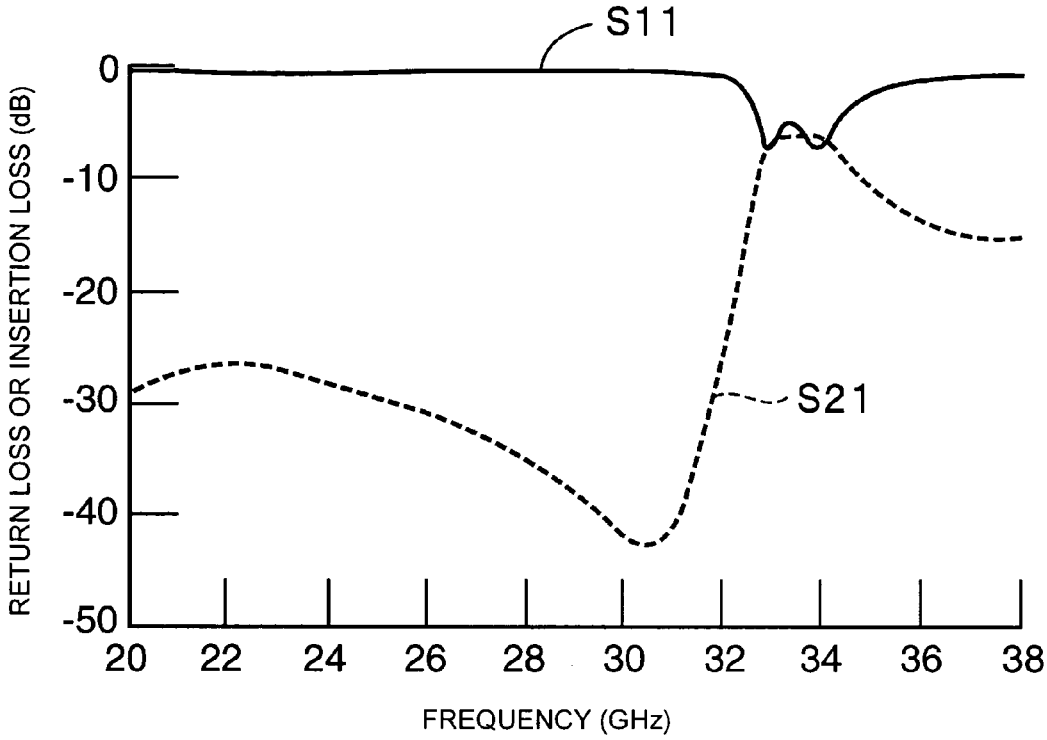
FIG. 13 shows S-parameter frequency characteristics of the dual-mode bandpass filter of the first preferred embodiment when the resonator electrode is removed and when the width is decreased.
Figure 14:
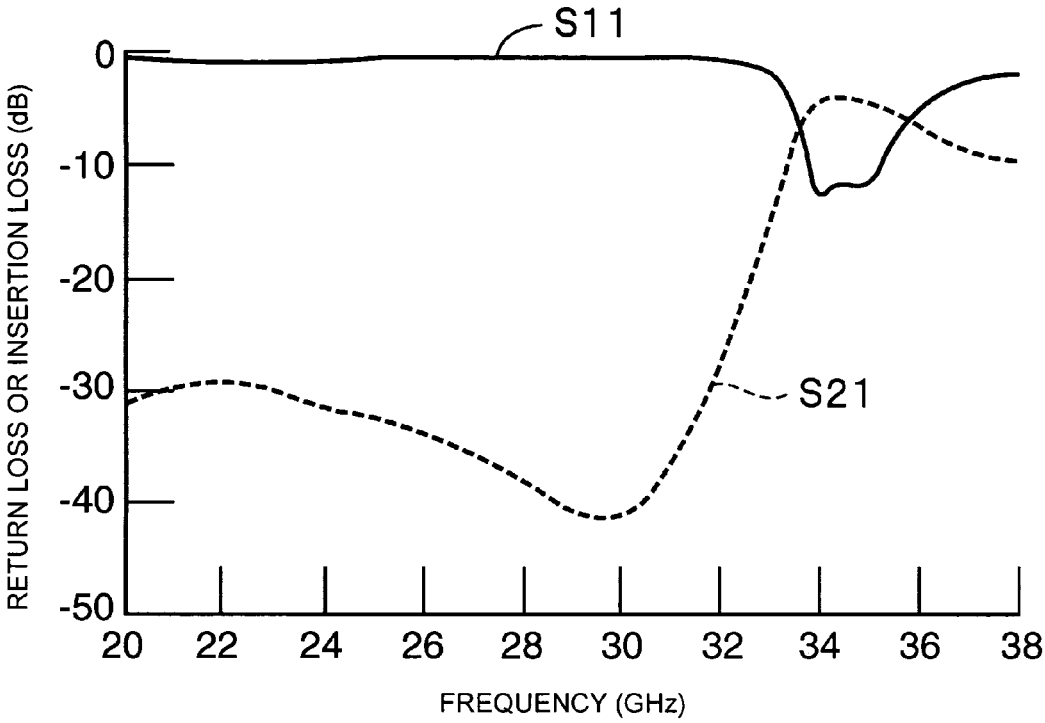
FIG. 14 shows S-parameter frequency characteristics of the dual-mode bandpass filter of the second preferred embodiment when resonator electrode is removed and when the width is decreased.

FIG. 13 shows S-parameter frequency characteristics of the dual-mode bandpass filter 1 when the resonator electrode 3 is removed and when the width is decreased as described above. FIG. 14 shows S-parameter frequency characteristics of the dual-mode bandpass filter 21 when the resonator electrode 3 is removed and when the width is decreased as described above.

The comparison between FIG. 13 and FIG. 4 shows that, when the width is decreased due to the manufacturing errors in the dual-mode bandpass filter 1, the fundamental resonant frequency of the spurious signals caused by the resonances of the first to third ground electrodes 6 to 8 shifts from about 31.32 GHz to about 32.87 GHz.

The comparison between FIG. 11 and FIG. 14 shows that, when the width is decreased in the dual-mode bandpass filter 21 of the second preferred embodiment, the fundamental resonant frequency of the spurious signals caused by the resonances of the first to third ground electrodes 6 to 8 shifts from about 33.56 GHz to about 33.98 GHz.

In the dual-mode bandpass filter 21, the shift in the resonant frequency of the spurious signals when the chip size varies is reduced as compared to the shift in the dual-mode bandpass filter 1. In other words, the variation in the frequency of the spurious signals caused by the variation in the chip size resulting from the manufacturing errors is reduced in the dual-mode bandpass filter 21, thus reducing the variation in the transmission characteristics.

The reasons that the variations in the frequency of the spurious signals caused by the variation in the chip size are reduced in the dual-mode bandpass filter 21, as described above, will be described below.

In the dual-mode bandpass filter 1, the variation in width changes the size of spaces between the central first via-hole electrode 9 and both longitudinal sides of the dual-mode bandpass filter 1. Since the resonance in a transverse electric (TE) mode depends on the size of the spaces, the frequency varies with the variation in the size of the spaces.

In contrast, in the dual-mode bandpass filter 21, since the spaces are fixed by the second via-hole electrodes 22 to 25 around the resonator electrode 3 and the central first via-hole electrode 9, any variation in the width of the chip does not cause a change in the size of the spaces. Hence, the variation in the spurious signals caused by the manufacturing errors is suppressed in the dual-mode bandpass filter 21.

Figure 15:
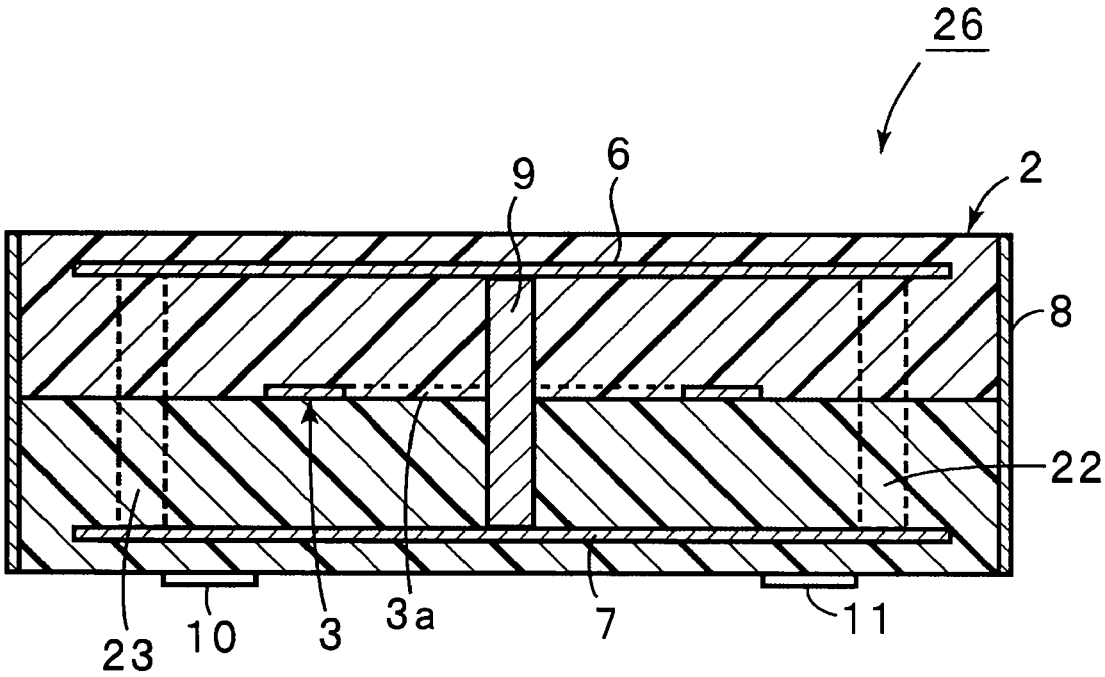
FIG. 15 is a cross-sectional front view showing a modification of the dual-mode bandpass filter of the present invention.

FIG. 15 shows a modified dual-mode bandpass filter 26. As shown in FIG. 15, the first ground electrode 6 and the second ground electrode 7 are provided inside the dielectric substrate 2.

Figure 16:
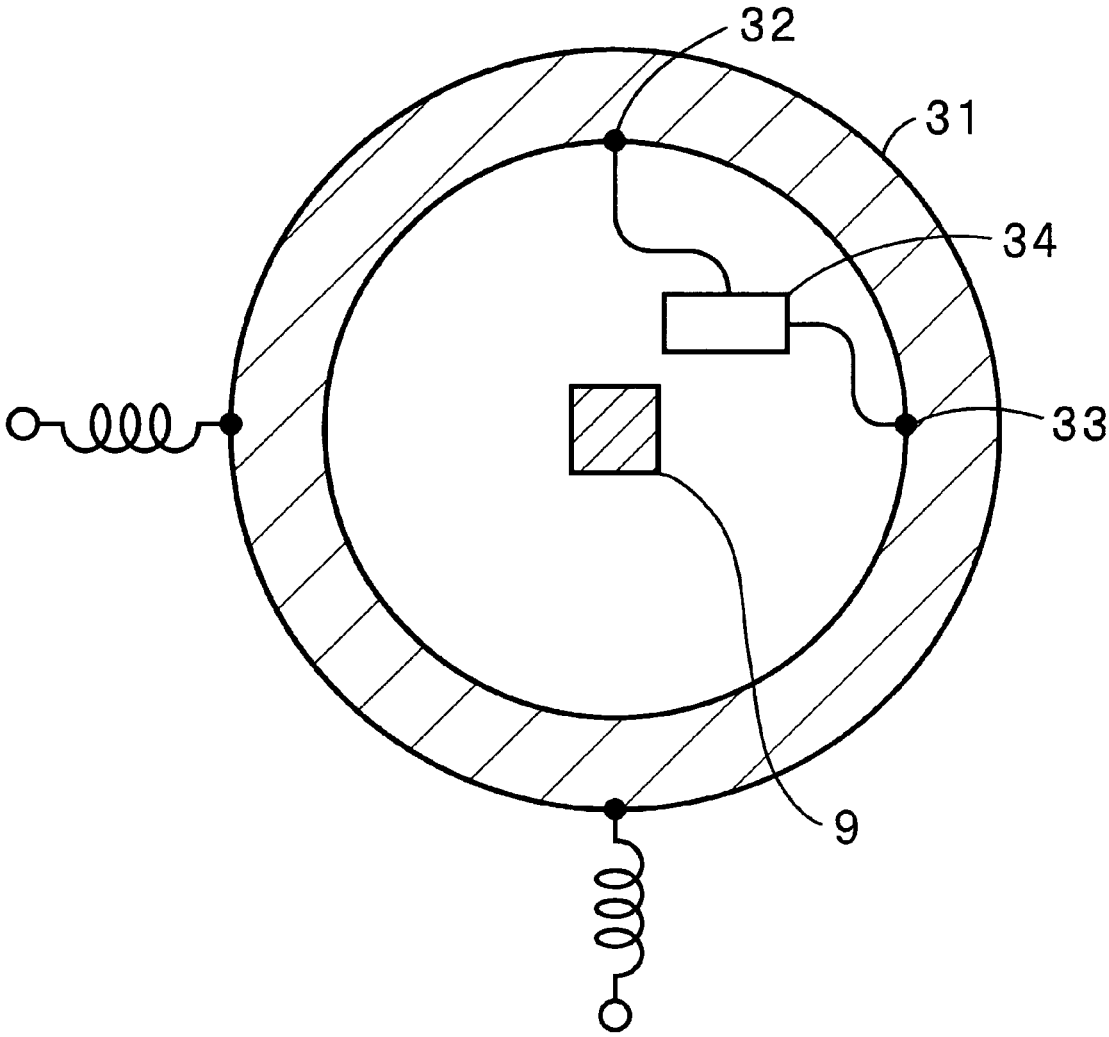
FIG. 16 is a plan view schematically showing another modification of the dual-mode bandpass filter of the present invention.
Figure 17A:
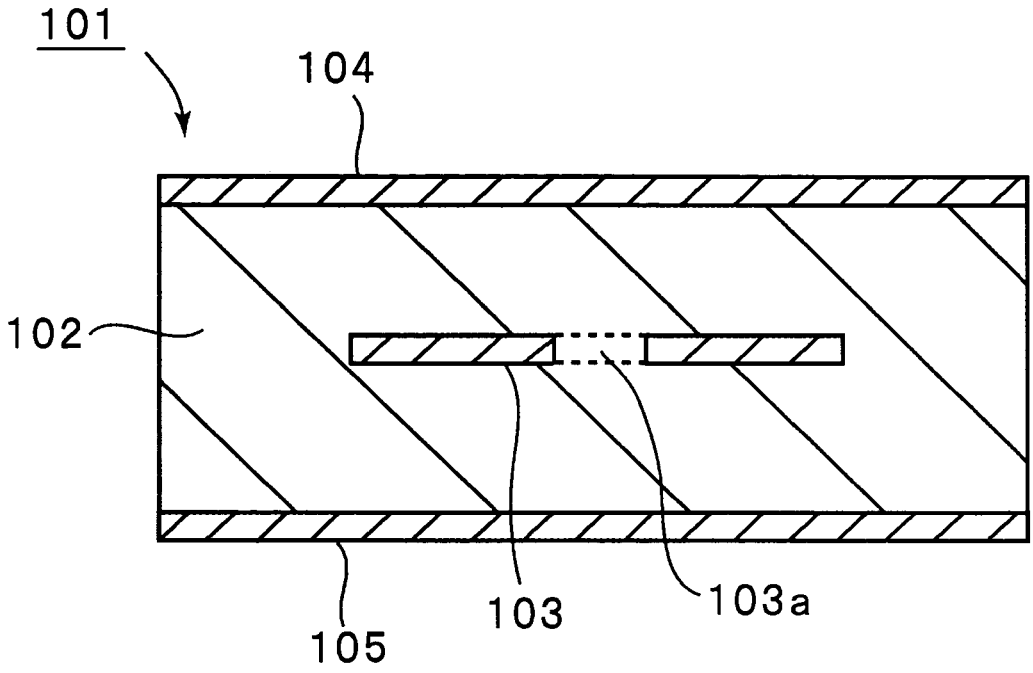
FIG.17A PRIOR ART
FIG. 17A is a cross-sectional front view and FIG. 17B is a plan view, schematically showing a known dual-mode bandpass filter.
Figure 17B:
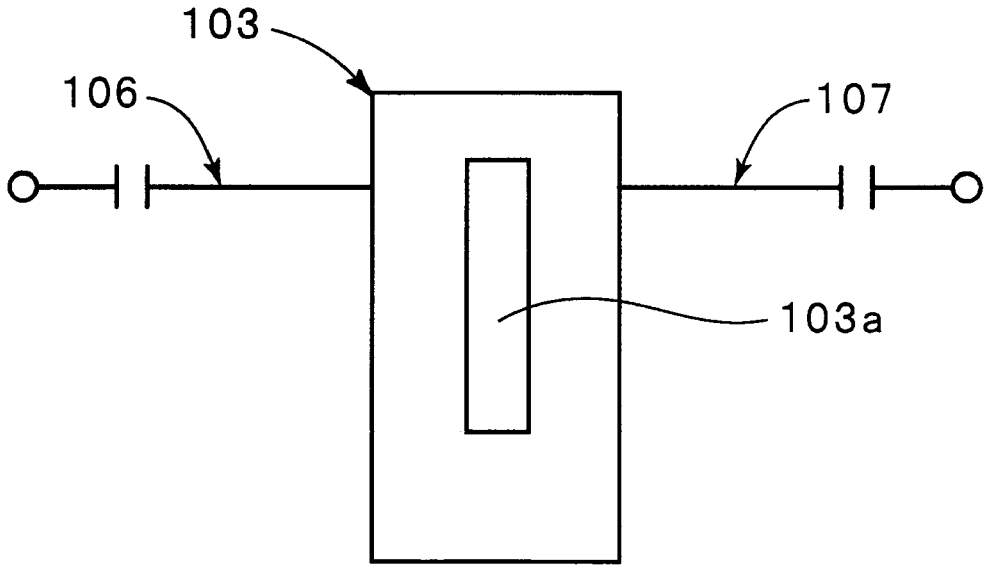
FIG.17B PRIOR ART

Although the aperture as disclosed in the publication described above causes the plurality of non-degenerate resonant modes to be coupled to each other to provide the bandpass filter characteristics in the dual-mode bandpass filter 1 of the first preferred embodiment and the dual-mode bandpass filter 21 of the second preferred embodiment, the present invention is not limited to such bandpass filters. For example, the present invention can also be applied to a known dual-mode bandpass filter in FIG. 16, having a ring resonator electrode 31. With the known dual-mode bandpass filter, controlling coupling points 32 and 33 to the ring resonator electrode 31 provides the bandpass filter characteristics. A feedback circuit 34 is provided to control the degree of coupling in the known dual-mode bandpass filter in FIG. 16.

As described above, the present invention can be applied to various bandpass filters using resonator electrodes with various shapes, as long as the resonator electrodes have the respective apertures.

The present invention is not limited to the above-described preferred embodiments, but can be modified in the scope of the attached claims. Further, the technologies disclosed in the above-described preferred embodiments can be used in combination, as desired.

What is claimed is:

1. A bandpass filter comprising:

a dielectric substrate;

a resonator electrode provided on a portion of a plane at an intermediate height in the thickness direction of the dielectric substrate so as to oppose a top surface of the dielectric substrate and includes an aperture;

first and second ground electrodes arranged over and under the resonator electrode, respectively, in the thickness direction of the dielectric substrate so as to oppose the resonator electrode with dielectric layers disposed therebetween and so as to sandwich the resonator electrode;

input-output coupling electrodes coupled to the resonator electrode;

input-output terminal electrodes provided on the outside surface of the dielectric substrate and being electrically connected to the input-output coupling electrodes; and a via-hole electrode that penetrates through the aperture in the thickness direction of the dielectric substrate so as not to be electrically connected to the resonator electrode and that is electrically connected to the first and second ground electrodes.

2. A bandpass filter according to claim 1, further comprising second via-hole electrodes provided in an area outside the resonator electrode in a plan view of the resonator electrode and that are electrically connected to the first and second ground electrodes.

3. A bandpass filter according to claim 1, wherein the resonator electrode is arranged to have a plurality of non-degenerate resonant modes and such that the plurality of resonant modes are coupled to each other by the aperture to define a dual-mode bandpass filter.

4. A bandpass filter according to claim 1, wherein the resonator electrode is a ring resonator electrode.

5. A bandpass filter according to claim 1, wherein the first and second ground electrodes are disposed on an upper and lower surface of the dielectric substrate, respectively.

6. A bandpass filter according to claim 1, wherein the first and second ground electrodes are disposed inside of the dielectric substrate, respectively.

7. A bandpass filter according to claim 1, wherein the resonator electrode has a substantially rectangular shape.

8. A bandpass filter according to claim 1, wherein said input-output coupling electrodes are disposed on a portion of a plane at an intermediate high in the thickness direction of the dielectric substrate.

9. A bandpass filter according to claim 1, wherein the aperture is disposed at a central portion of the resonator electrode.

10. A bandpass filter according to claim 1, wherein the first and second ground electrodes are larger than the resonator electrode.

11. A bandpass filter according to claim 1, further comprising at least one additional via-hole electrode connected to at least one of the input-output electrodes.

* * * * *